US010054287B2

(12) United States Patent
Fieberg et al.

(10) Patent No.: US 10,054,287 B2
(45) Date of Patent: Aug. 21, 2018

(54) HIGH INTENSITY MARINE LED STROBE AND TORCH LIGHT

(71) Applicants: Dirk Fieberg, Groton, MA (US); Charles L. Frey, Melbourne Beach, FL (US)

(72) Inventors: Dirk Fieberg, Groton, MA (US); Charles L. Frey, Melbourne Beach, FL (US)

(73) Assignee: Arctic Rays, LLC, Groton, MA (US)

( * ) Notice: Subject to any disclaimer, the term of this patent is extended or adjusted under 35 U.S.C. 154(b) by 0 days.

(21) Appl. No.: 15/602,681

(22) Filed: May 23, 2017

(65) Prior Publication Data

US 2017/0343185 A1 Nov. 30, 2017

Related U.S. Application Data

(60) Provisional application No. 62/341,410, filed on May 25, 2016.

(51) Int. Cl.
*F21V 1/00* (2006.01)
*F21V 5/04* (2006.01)
(Continued)

(52) U.S. Cl.
CPC ..... *F21V 5/045* (2013.01); *F21S 9/02* (2013.01); *F21V 3/00* (2013.01); *F21V 15/01* (2013.01);
(Continued)

(58) Field of Classification Search
CPC ..... F21V 5/045; F21V 31/0085; F21V 25/10; F21V 23/0407; F21V 15/01; F21V 3/00; F21S 9/02; F21Y 2115/10
See application file for complete search history.

(56) References Cited

U.S. PATENT DOCUMENTS 5,016,151 A 5/1991 Mula
6,481,148 B1 11/2002 Lindgren
(Continued)

FOREIGN PATENT DOCUMENTS

CN 106224833 A 12/2016
DE 102008021882 A1 1/2010

OTHER PUBLICATIONS

Joseph R. Curran; "A Strategy for the Use of Light Emitting Diodes by Autonomoues Underwater Vehicles", © Massachusetts Institute of Technology (1999). 169 pages.
(Continued)

*Primary Examiner* — Ali Alavi
(74) *Attorney, Agent, or Firm* — St. Onge Steward Johnston & Reens, LLC

(57) ABSTRACT

A submersible light fixture including an outer casing with a window and a housing, the outer casing being sealed for operation underwater, an LED array within the outer casing behind the window including a plurality of light-emitting diodes, and a driver within the outer casing including a microprocessor, at least one capacitor, a charging circuit, and discharging circuit. The charging circuit charges the at least one capacitor to a voltage of at least two times a forward voltage of the LED array. The discharging circuit delivers power from the at least one capacitor to the LED array in discrete pulses at a voltage of at least two times the forward voltage of the LED array.

20 Claims, 6 Drawing Sheets

(51) Int. Cl.

| | |
|---|---|
| ***F21V 31/00*** | (2006.01) |
| ***F21V 3/00*** | (2015.01) |
| ***F21V 15/01*** | (2006.01) |
| ***F21V 23/04*** | (2006.01) |
| ***F21V 23/00*** | (2015.01) |
| ***F21V 23/06*** | (2006.01) |
| ***F21V 25/10*** | (2006.01) |
| ***F21S 9/02*** | (2006.01) |
| *F21Y 115/10* | (2016.01) |

(52) U.S. Cl.
CPC ..... *F21V 23/005* (2013.01); *F21V 23/0407* (2013.01); *F21V 23/06* (2013.01); *F21V 25/10* (2013.01); *F21V 31/005* (2013.01); *F21Y 2115/10* (2016.08)

(56) References Cited

U.S. PATENT DOCUMENTS

| | | | | |
|---|---|---|---|---|
| 7,088,222 | B1 | 8/2006 | Dueker et al. | |
| 7,287,873 | B2 | 10/2007 | Galli | |
| 8,033,677 | B1 * | 10/2011 | Olsson | F21V 7/0083 362/101 |
| 8,167,468 | B1 | 5/2012 | Olsson et al. | |
| 8,172,434 | B1 | 5/2012 | Olsson | |
| 8,632,230 | B2 * | 1/2014 | Olsson | F21V 7/0083 362/477 |
| 8,690,374 | B2 | 4/2014 | Miller | |
| 9,162,740 | B2 | 10/2015 | Hardy et al. | |
| 9,188,292 | B2 | 11/2015 | Armer et al. | |
| 9,225,883 | B2 | 12/2015 | Kossin | |
| 9,388,973 | B1 | 7/2016 | Olsson et al. | |
| 2006/0002110 | A1 | 1/2006 | Dowling et al. | |
| 2007/0279900 | A1 * | 12/2007 | Bauer | F21S 8/00 362/158 |
| 2008/0080168 | A1 * | 4/2008 | Harris | F21S 8/00 362/101 |
| 2013/0128600 | A1 | 5/2013 | Bjorn | |
| 2015/0176817 | A1 * | 6/2015 | Olsson | F21V 15/01 362/249.02 |

OTHER PUBLICATIONS

Sea & Sea YS-D2 Underwater Strobe SS-03117 B&H Photo Video, 5 pages, © 2000-2017 B & H Foto & Electronics Corp.

Olsson, et al., "Underwater Applications of High-Power Light-Emitting Diodes". Aug. 2007, 7 pages.

* cited by examiner

HIGH INTENSITY MARINE LED STROBE AND TORCH LIGHT

FIELD OF THE INVENTION

The invention relates to light-emitting diode devices, and more specifically to a high intensity light-emitting diode strobe and torch light for marine applications.

BACKGROUND OF THE INVENTION

Light-emitting diode ("LED") strobes are typically comprised of a single LED or an array of LEDs. They generally include a drive circuit that is a constant current source. The energy to the LEDs is generally controlled by a pulse width modulation ("PWM") signal which provides short bursts of energy to the LED or LED array.

A typical high power LED can withstand a drive current of up to 1.4 amps (A) continuously. In order to achieve higher light outputs, it is necessary to provide a higher current level to the LEDs. However, this would require exceeding 1.4A which can risk failure of the LED and require careful attention to be paid to the supporting circuitry in order to achieve optimal performance within a constrained operating range. Further, the drive circuit providing the constant current generally increases significantly in size in order to provide higher power levels higher current levels. This would lead to larger components which may not be acceptable for many applications due to size constraints. For example, a typical inductor for a 1.4A constant current (CC) driver is 4.3 mm square and 4.1 mm high. A typical inductor for 18A CC driver is 16.4 mm square and 10 mm high.

Therefore, what is desired is an improved high power LED light that overcomes the disadvantages in the prior art.

SUMMARY OF THE INVENTION

It is an objective of the present invention to provide an LED light with a high voltage potential LED driver, referred to by applicants as a high voltage pulse driver, rather than a traditional constant current or constant voltage only driver. It is a further objective to provide such an LED light with a driver that is compact and lightweight allowing for high intensity LED strobes to be used in smaller and lighter fixtures.

It is a further objective to provide such an LED light with circuitry to allow for the selection of both strobe and torch (i.e., constant light) modes in the same fixture. It is a further objective to provide a light with a power output up to about 10,000 lumens or more in the torch mode and at least 20,000 lumens even 30,000 lumens or more in the strobe mode while maintaining a small form factor.

In one aspect, the invention may include a light fixture with an LED array powered by a high voltage potential energy source controlled precisely by a microprocessor and discharge circuit to produce a specific strobe duration while optimizing the light output and protecting the LED array. Rather than operating at a constant current or even a constant voltage, the device delivers a very high voltage pulse to the LED array over a short duration by means of capacitors. The capacitors store a charge that is at least two times the forward voltage of the LED array. The capacitors may store and provide a charge of ten times the forward voltage of the LED array.

In one exemplary embodiment, a submersible light fixture is provided including an outer casing including a window and a housing, the outer casing being sealed for operation underwater, an LED array within the outer casing behind the window including a plurality of light-emitting diodes, and a driver within the outer casing including a microprocessor, at least one capacitor, a charging circuit, and discharging circuit. The charging circuit charges the at least one capacitor to a voltage of at least two times a forward voltage of the LED array. The discharging circuit delivers power from the at least one capacitor to the LED array in discrete pulses at a voltage of at least two times the forward voltage of the LED array.

The fixture preferably produces at least 25,000 or at least 30,000 lumens in a strobe mode. In some embodiments, the capacitor may further charge to and deliver at least five or ten times the forward voltage. In some embodiments, the microprocessor limits at least one of a maximum pulse duration and repetition rate of the power delivered to the LED array to protect the array.

In some embodiments, the driver further includes a torch circuit for providing constant current from a power source to the LED array, the driver selectively switchable between the torch circuit and the discharging circuit. The fixture may produce 10,000 lumens at 105W or less when receiving power via the torch circuit.

The present invention may also include a submersible light fixture including an outer casing including a window and a housing, the outer casing having a diameter of less than 80 mm and being sealed for operation at depths of at least 1,000 m, an LED array within the outer casing including a plurality of light-emitting diodes a forward voltage of less than 35V, a high voltage potential LED driver, within the outer casing, including a at least one capacitor, a charging circuit charging the at least one capacitor, and a discharging circuit delivering power from the at least one capacitor to the LED array in discrete pulses at a voltage of at least two times the forward voltage, the driver including a microprocessor limit at least one of maximum pulse duration and repetition rate.

Further provided is a method of operating a light fixture, including steps of charging, via a charging circuit of a driver board, at least one capacitor to a voltage of at least two times a forward voltage of an LED array of the light fixture, discharging, via a discharging circuit of a driver board, power from the at least one capacitor to the LED array in discrete pulses at a voltage of at least two times the forward voltage, and regulating at least one of a maximum pulse duration and repetition rate of the discharging.

Other objects of the invention and its particular features and advantages will become more apparent from consideration of the following drawings and accompanying detailed description.

DETAILED DESCRIPTION OF THE INVENTION

Figure 1:
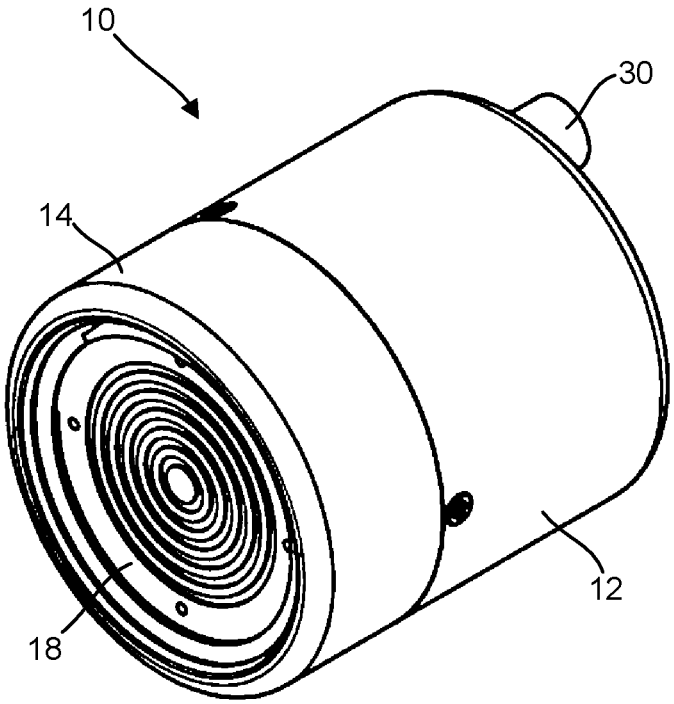
FIG. 1 illustrates an LED light according to an exemplary embodiment of the present invention.

FIG. 1 illustrates an LED light 10 according to an exemplary embodiment of the present invention. The light 10 includes an outer casing comprised of a housing 12 and an endcap 14 which are connected together with fasteners 16 (e.g., screws) to form the outer casing.

The outer casing may be made of aluminum, titanium, thermoplastics, or any other suitable material, and has a small form factor. In some embodiments, the outer casing has a length of 80 mm or less and a diameter of 70 mm or less. In other embodiments, the diameter is 50 mm or less. In the exemplary embodiment, the light 10 has a weight of 700 g or less (420 g in salt water), such as 600 g (318 g in salt water).

The outer casing is preferably hermetically sealed, e.g., between the housing 12 and the endcap 14 and around any other openings. With the electronics enclosed in a hermetically sealed casing, the light 10 is capable of operating under water and/or in extreme environments such as deep sea marine applications and even explosive environments. In some embodiments, the light 10 is capable of operating at depths of at least 1,000 m (3,300 ft). In other embodiments, the light 10 is capable of operating at depths of at least 6,000 m (19,700 ft).

The light 10 may be used for photography, beacons, emergency signals, personal locators, or other types of lighting where the intent is to gain the attention. The light 10 is particularly useful on autonomous underwater vehicles (AUV) given its small form factor, hydrodynamic profile, and high output. For example, an AUV may have a light 10 or a series of lights 10 attached thereto to facilitate underwater photography and/or for locating the AUV in recovery operations.

Figure 2:
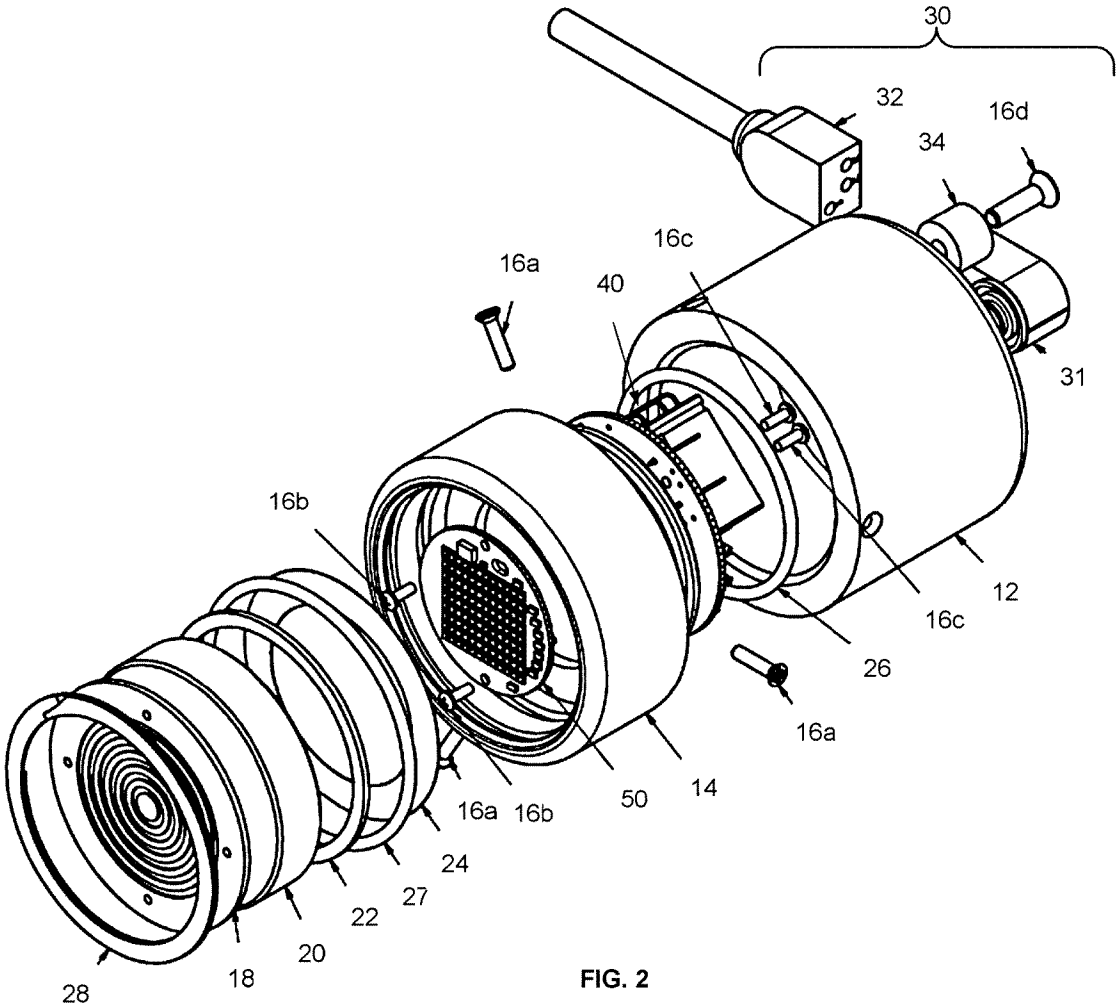
FIG. 2 is an exploded view of an LED light according to an exemplary embodiment of the present invention.

FIG. 2 is an exploded view of the light 10 show in FIG. 1. The front of the outer casing includes a window 20. The window 20 may, for example, be comprised of glass, acrylic, or sapphire. The light 10 further includes a lens 18 (e.g., such as a Fresnel lens). An LED array 50 is contained with the outer casing including a plurality of LED's. In the exemplary embodiment, each LED is rated for 1.4A and the LED array 50 has a forward voltage (VF) of approximately 30 V or 34 V. The LED array 40 is electrically connected to a driver board 40, described in more detail below.

Figure 3:
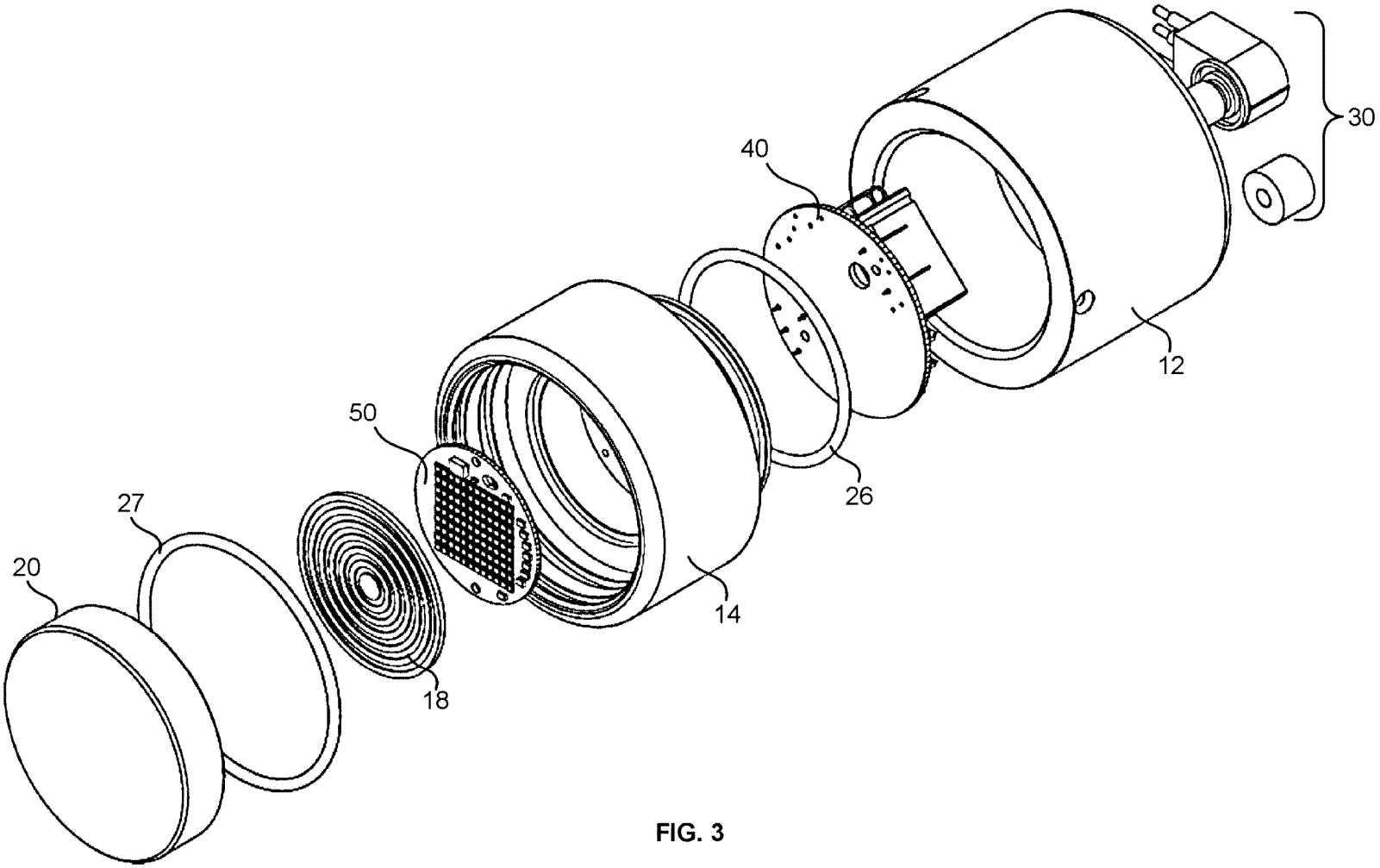
FIG. 3 is an exploded view of an LED light according to an exemplary embodiment of the present invention.

The window 20 seals off the front of the housing to protect the internal components such as the driver board 40, the LED array 50, and associated components. In the embodiment of FIG. 2, the lens 18 is exterior to the window 20. However, in other embodiments, as shown in FIG. 3, the lens 18 is behind the window 20. The light 10 may further include spacers 22, 24 and O-rings 26, 27 between the various components. A spiral retaining ring 28 is fitted on a distal end of the light 10.

In the embodiment of FIG. 3, lens 18 is a Fresnel lens and is installed in the air tight space between the LED array 50 and the main window 20 to ensure the proper light effect desired. The material of the Fresnel lens 18 may be a rigid plastic such as acrylic or soft material such as silicon.

In non-submersible lighting applications, a Fresnel lens can be used in place of a main exterior window. However, with the extreme pressure experienced by a submersible light, the generally delicate Fresnel lens is susceptible to being crushed. Further, the optical beam shaping characteristics of the Fresnel lens may be lost if exposed to water. Thus, in the present embodiment, the main window 20 is responsible for sealing the product and withstanding the extreme pressure the product will experience while the Fresnel lens is secured in a space surrounded by air.

The efficiency of the Fresnel beam shaping feature is maximized by the LED array 50 being designed in a tight pattern. When operating in the strobe mode, a standard acrylic Fresnel lens may be acceptable since the heat from the optical power onto the lens will dissipate quickly. However, in the present invention which also operates in a torch mode, the optical power is so high that it could deform and damage an acrylic lens. For this reason, a silicon version of the Fresnel lens is preferable.

At a rear portion of the housing 12, there is one or more connectors 30 for power and control inputs. For example, the light 10 may include a bulkhead connector 31, an inline connector 32, and an anode 34 (e.g., zinc anode) which is connected to the housing 12 with a fastener 16d. The connectors and anode are hermetically sealed. The light 10 may be synced to a TTL (transistor-transistor logic) camera shutter and may self-quench automatically when the shutter line is released, allowing user-controllable strobe durations up to 5 ms. Digital control over the LED array 50 allows the user to customize several parameters of the strobe light, including pulse width and pulse duty cycle.

In some embodiments, the light is output in a 62° beam. The light 10 may also be focused to a narrower beam, such as 35° or less. In applications that require a more precise optical beam pattern (e.g., less than 35 degrees), the LED array 50 may include individual reflectors or TIR (total internal reflection) optics for each LED, achieving beam angles as small as 6 degrees. In embodiments where each LED has a dedicated optic, the LED pattern may be expanded and/or the number of LEDs reduced due to space constraints. This is primarily used in the torch mode. In some embodiments, a CREE XPL2 LED (e.g., or other comparable LED) is used to optimize the desired bean angle and available TIR optic. TIR optics, if used, are mounted onto the LED board and are protected by the main window 20 of the light 10. This setup is generally not found in prior art underwater lights which typically rely on small reflectors to achieve some beam shaping.

Figure 4:
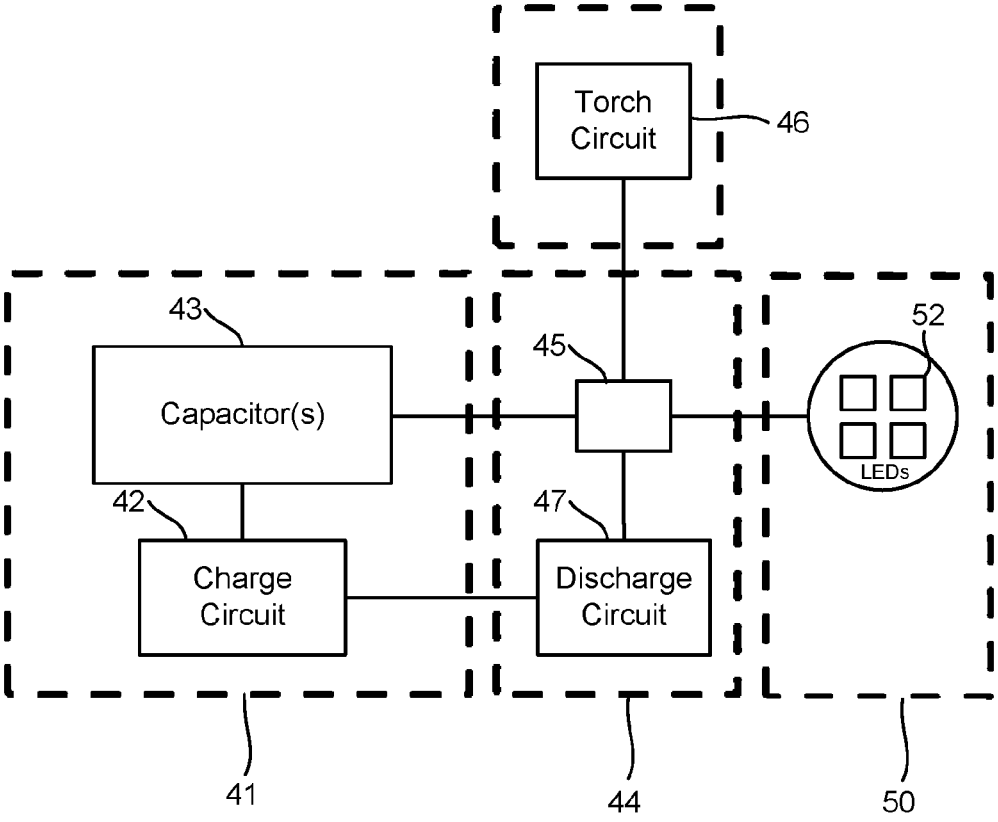
FIG. 4 is a schematic diagram of the circuits of an LED light according to an exemplary embodiment of the present invention.

As shown in FIGS. 2 and 3, the LED driver or driver board 40 is contained within the outer casing of the light 10 including various circuits. A schematic of various circuits and components of driver board 40 are shown in FIG. 4. The light 10 includes a capacitor charging circuit or module 41, a main microprocessor and discharging circuit or module 44, and in some embodiments, a torch (or constant light) circuit or module 46. The circuits or modules may be integrated together on the board 40. In one embodiment, the torch circuit 46 is located on a separate board from the other circuits. As shown in FIG. 4, the light 10 further includes the LED array 50 in electrical communication with the circuits of the board 40.

Figure 5:
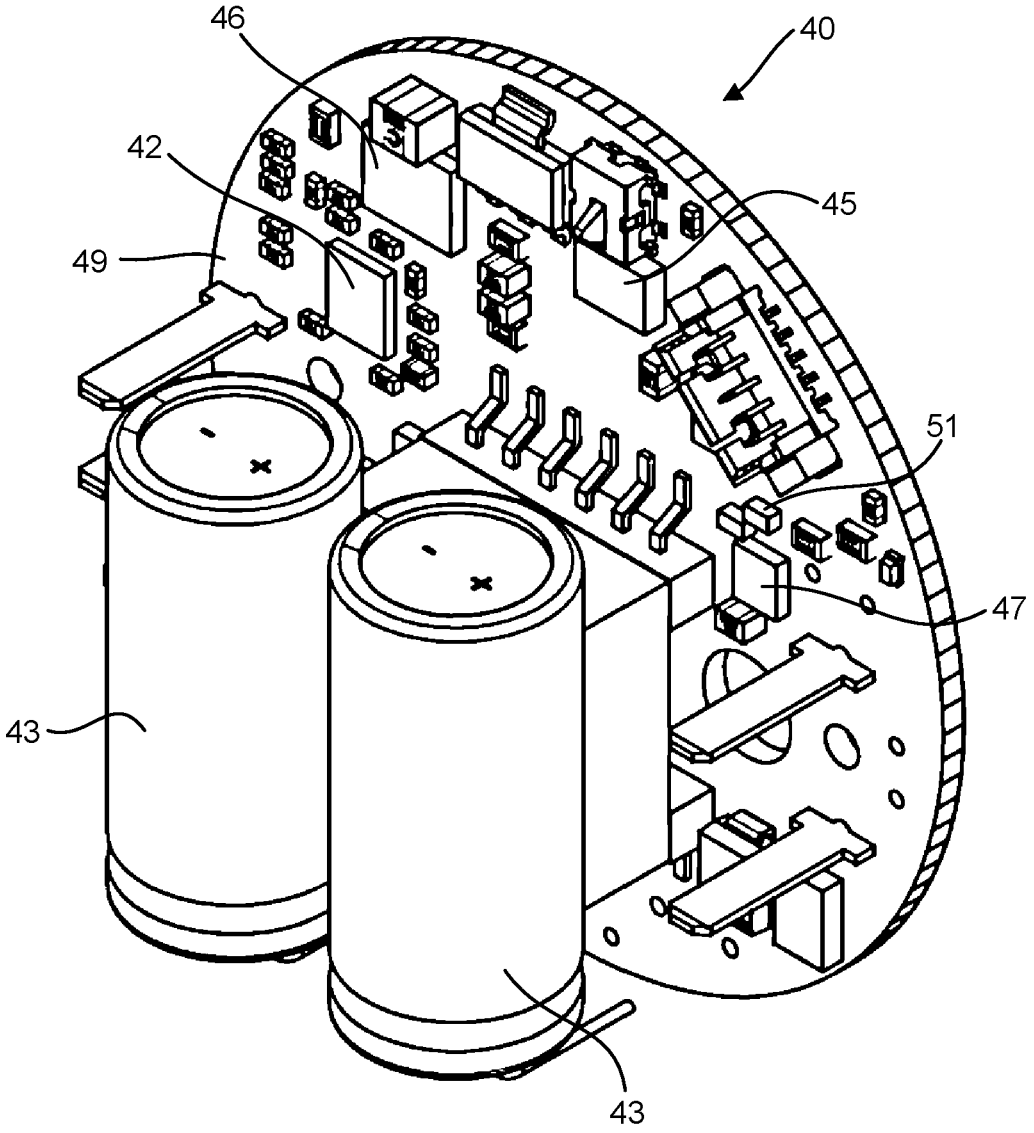
FIG. 5 is a drive circuit board of an LED light according to an exemplary embodiment of the present invention.

FIG. 5 further illustrates the driver board 40. The board 40 includes a substrate 49 to which the integrated circuits (IC), capacitors, and other components are mounted. The capacitor charging circuit or module 41 is comprised of an integrated circuit (charging/strobe circuit) 42, peripheral circuitry and a single or multiple capacitors 43 capable of holding a desired charge for the LED array 50. The charging circuit 42 receives power from a source and continuously charges the capacitors 43. Input power to the charging circuit 41, to charge the capacitors 43, can be either from a DC power source (in the light 10 or preferably external thereto)

or from a rectifying circuit that converts AC voltages to suitable DC voltage. In some embodiments, the input power is supplied externally via the connectors 30 from a DC power source of an AUV.

The charging of the capacitors 43 is controlled by the integrated circuit 42, which is triggered by the main microprocessor 45 on the board 40. Discharging of the capacitor (s) 43 is also controlled or triggered by the main microprocessor 45. The main microprocessor 45 has multiple functions. For example, it may accept input signals from external sources (e.g., via connectors 30 or wirelessly) such as a flash or quench function, initiate or trigger the charging of the capacitors 43, execute the discharge cycle by triggering an input to the discharge circuit 47, initiate the discharge when either a programmed event has occurred on an external trigger is present, control the duration of the discharge in order to avoid damaging the LED array 50, terminate the discharge cycle either by a pre-programmed behavior or an external trigger, and limit the amount of repetitive discharge in order to allow the circuit to return to a ready state and/or limit the thermal exposure of the LED and guarantee the proper operation of the light 10. In some embodiments, the microprocessor 45 receives a control input signal in form or a serial communication protocol to indicate a pulse width and duration required. The main microprocessor 45 may also monitor the temperature of the LED array 50 as well as other internal components to avoid thermal damage (e.g., via sensors), utilize secondary indicator LEDs 53 to provide status updates to the user, and record data to assist in future developments and monitoring of the light 10.

The discharge circuit 47 is designed to carry the current necessary to power the LEDs in addition to surviving the high voltage potential it is subjected to. The response time of the discharge circuit 47 is at least fast enough to be able to minimize the delay between an external trigger and the delivery of power to the LED array 50. The discharge circuit 47 has the capability to limit the amount of current inrush to the LED array 50. In the exemplary embodiment, the discharge circuit 47 is or includes an insulated-gate bipolar transistor ("IGBT"), metal-oxide-semiconductor field-effect transistor ("MOSFET"), or other solid state switch/relay device capable of being triggered by another component, e.g., the microprocessor 45.

The capacitor(s) 43, or array of capacitors, are of sufficient capacity to provide current to the LED array 50 at a voltage level of minimum two times (2×), and preferably more than 2×, the forward voltage of the LED array 50. The charging IC 42 and peripherals are designed to charge the capacitors 43 to a voltage of at least two times (2×), and preferably more than 2×, the forward voltage of the LED array 50. In some embodiments, the capacitors 43 are charged much higher to achieve a greater light output, such as 5-10 times forward voltage.

In the exemplary embodiment, the LED array 50 has a forward voltage of 30V and the capacitor or capacitor array 43 is rated to at least 300V. Up to 300V or more is delivered in a pulse to the LED array 50 by the capacitors 43. Thus, rather than operating at a constant current or even a constant voltage, a very high voltage pulse is delivered to the LED array 50 over a short duration by means of the capacitors 43. This results in large current, such as 18-28A, over the short duration. The present invention advantageously achieves this high voltage and high current while still maintaining a very small form factor. As one skilled in the art would understand, to achieve up to 28A with a traditional constant current arrangement, the size of the device would be much larger.

Discharge may be initiated when either a programmed even has occurred or an external trigger is present. The duration of the discharge is controlled by the microcontroller 45 and/or the discharging circuit 47 to avoid damaging the LED array 50 given that the rated power of each LED is being exceeded with an instantaneous current spike. In one exemplary embodiment, the duration is adjustable from nanoseconds up to a limit of approximately 5 milliseconds (ms). The discharge cycle may be terminated by a pre-programmed behavior or an external trigger. The amount or repetitiveness of discharge may be limited to allow the circuit to return to a ready state, and/or the thermal exposure of the LED may be limited to ensure proper operation of the light 10.

In some embodiments, the light 10 includes one or more sensors 51 to monitor the temperature of the LED array 50 as well as other internal components to avoid thermal damage. The light 10 may also include secondary indicator LEDs (e.g., 53) to provide status updates to the user. The light 10 may further include a mechanism to record data to assist in future developments and monitoring of the light 10.

The optional torch (or constant light) circuit 46 provides a constant current to the LED array 50. The current feed to the LED array 50 is controlled by the main microprocessor 45, and/or the discharge circuit 47, which can also switch between the torch function and the strobe function. Switching between the torch function and strobe function also changes where power to the LED array 50 is supplied from. For example, the LED array 50 receive power pulsed from the capacitors 43 when in strobe mode. In torch mode, a constant power feed may come from an DC or AC power supply (e.g., the same power supply which charges the capacitors 43), such as a power supply in a AUV on which the light 10 is mounted.

The torch circuit 46 can accept various external control sources (e.g., via the connectors 30). These control inputs could range from analog to digital inputs such as, voltage inputs, current inputs, serial communication protocols and pulse width modulation.

The driver 40 and/or torch circuit 46 can thermally monitor the performance of not only the LED array 50 but also the power electronics, ensuring that the system can self-protect in the event that it is used in a non-suitable environment. In particular, in some embodiments, the LED board 50 has a microchip temperature monitoring integrated circuit (IC) 51 that generates a signal/flag to the main microprocessor indicating an over-temperature condition. The condition may be communicated to a user via an audio or visual indicator (e.g., LED indicator 53) or via a signal sent to a remote location. There may be a gradient between the actual LED temperature and the one sensed by the IC 51. In some cases, the IC 51 is tested to set the warning signal to the right level.

In some embodiments, a microchip temperature monitoring IC 51 is also located on the driver board 40, such as under the hottest components (typically MOSFET's). This allows the microprocessor 45 to throttle back the output power to the LEDs based on the input from either temperature IC 51 or even shut the light 10 down in extreme cases. Since the light 10 is intended to be used submerged, all thermals that guarantee the reliable operation are designed with water cooling in mind.

Figure 6:
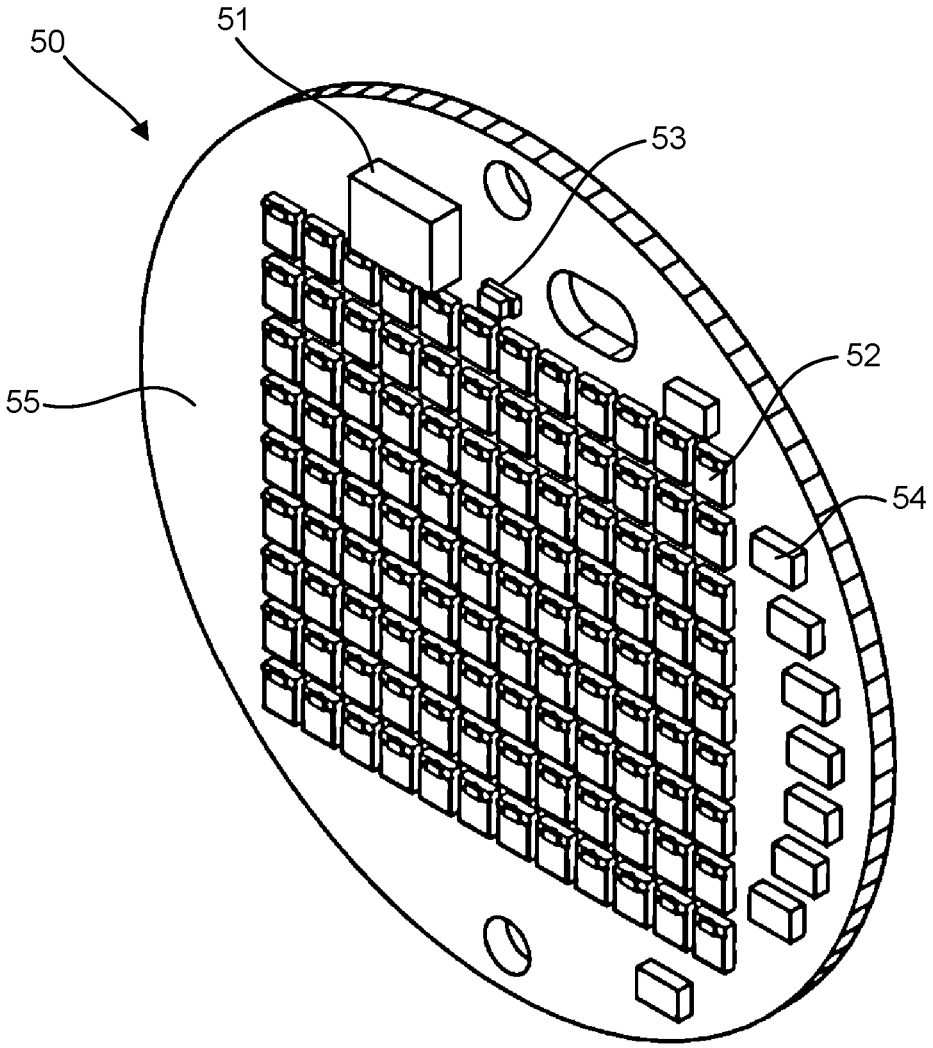
FIG. 6 is an LED array of an LED light according to an exemplary embodiment of the present invention.

The LED array 50 is further illustrated in FIG. 6. The LED array 50 is comprised of two or more high powered LEDs in series and/or parallel strings in which the number of LEDs in each string is two or more and the number of parallel strings is two or more. In the exemplary embodiment, there are one-hundred and eight LEDs 52 arranged as twelve LEDs 52 in each of nine parallel strings. Each of the strings also includes a resistor 54. The LEDs in the array 50 can be of any color depending on the application, such as white, red, blue, green, amber, lime to ultra violet and infrared. In some embodiments, the color/wavelength of the light is optimized for increased distance (e.g., underwater). The LED array 50 may also include the microchip temperature monitoring integrated circuit (IC) 51 and LED indicator 53. The LED indicator 53 may activate (e.g., blink) to relay operational messages such as startup and over-temperature conditions.

The LEDs are mounted on a substrate 55 capable of handling the thermal dissipation to provide a reliable solution. For example, the substrate may be an FR4 material with adequate thermal vias and copper planes or a solid metal core printed circuit board with a copper or aluminum core.

In the exemplary embodiment, the light 10 has an output greater than 25,000 lumens such as 26,000 lumens or up to and greater than 30,000 lumens. In torch mode, the light 10 is operable at low power (e.g., 105W) while producing up to 10,000 lumens or more.

Although the invention has been described with reference to a particular arrangement of parts, features and the like, these are not intended to exhaust all possible arrangements or features, and indeed many modifications and variations will be ascertainable to those of skill in the art.

What is claimed is:

1. A submersible light fixture, comprising:

an outer casing including a window and a housing, said outer casing being sealed for operation underwater;

an LED array within said outer casing, behind the window, including a plurality of light-emitting diodes;

a driver within said outer casing including a microprocessor, at least one capacitor, a charging circuit, and discharging circuit;

said charging circuit charging the at least one capacitor to a voltage of at least two times a forward voltage of said LED array;

said discharging circuit delivering power from the at least one capacitor to said LED array in discrete pulses at a voltage of at least two times the forward voltage of said LED array.

2. The submersible light fixture of claim 1, wherein said microprocessor limits at least one of a maximum pulse duration and repetition rate of the power delivered to said LED array.

3. The submersible light fixture of claim 1, wherein the fixture produces greater than 30,000 lumens.

4. The submersible light fixture of claim 1, wherein said driver further includes a torch circuit for providing constant current from a power source to said LED array, said driver selectively switchable between the torch circuit and the discharging circuit.

5. The submersible light fixture of claim 4, wherein said LED array produces greater than 25,000 lumens when receiving power via the discharging circuit and at least one capacitor.

6. The submersible light fixture of claim 4, wherein the fixture produces at least 10,000 lumens at 105W or less when receiving power via the torch circuit.

7. The submersible light fixture of claim 1, wherein the at least one capacitor has a capacity to provide at least five times the forward voltage to said LED array.

8. The submersible light fixture of claim 7, wherein the at least one capacitor has a capacity to provide up to ten times the forward voltage to said LED array.

9. The submersible light fixture of claim 1, wherein the fixture is operable at depths of at least 6,000 m.

10. The submersible light fixture of claim 1, further comprising a Fresnel lens within said outer casing behind the window.

11. The submersible light fixture of claim 1, wherein the discharging circuit comprises at least one of an insulated-gate bipolar transistor ("IGBT") or a metal-oxide-semiconductor field-effect transistor ("MOSFET").

12. The submersible light fixture of claim 1, further comprising at least one microchip temperature monitoring integrated circuit.

13. A method of operating a light fixture, including steps of:

charging, via a charging circuit of a driver board, at least one capacitor to a voltage of at least two times a forward voltage of an LED array of the light fixture;

discharging, via a discharging circuit of a driver board, power from the at least one capacitor to the LED array in discrete pulses at a voltage of at least two times the forward voltage; and regulating at least one of a maximum pulse duration and repetition rate of the discharging.

14. The method of claim 13, wherein the at least one capacitor has a capacity to charge up to ten times the forward voltage to said LED array.

15. The method of claim 13, further comprising the step of monitoring a temperature of at least one of the driver board or the array of light emitting diodes via a microchip temperature monitoring integrated circuit.

16. The method of claim 13, further comprising the step of selectively operating the LED array between a strobe mode and a torch mode.

17. The method of claim 13, wherein the fixture produces greater than 30,000 lumens.

18. A submersible light fixture, comprising:

an outer casing including a window and a housing, said outer casing having a diameter of less than 80 mm and being sealed for operation at depths of at least 1,000 m;

an LED array within said outer casing including a plurality of light-emitting diodes a forward voltage of less than 35V;

a high voltage potential LED driver, within said outer casing, including a at least one capacitor, a charging circuit charging the at least one capacitor, and a discharging circuit delivering power from the at least one capacitor to said LED array in discrete pulses at a voltage of at least two times the forward voltage;

said driver including a microprocessor limit at least one of maximum pulse duration and repetition rate.

19. The submersible light fixture of claim 17, said driver further including a torch circuit for providing constant current from a power source to said LED array, said driver selectively switchable between the torch circuit and the discharging circuit.

20. The submersible light fixture of claim 17, further comprising a Fresnel lens within said outer casing behind the window.

* * * * *